US011447726B2

(12) United States Patent
Delaney et al.

(10) Patent No.: US 11,447,726 B2
(45) **Date of Patent: *Sep. 20, 2022**

(54) DETERGENT COMPOSITIONS HAVING SURFACTANT SYSTEMS

(71) Applicant: The Procter & Gamble Company, Cincinnati, OH (US)

(72) Inventors: Sarah Ann Delaney, Hebron, KY (US); Patrick Christopher Stenger, Fairfield, OH (US); Meg Elizabeth Hall, Sunman, IN (US); Cheyne Thomas, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/691,650

(22) Filed: Nov. 22, 2019

(65) Prior Publication Data

US 2020/0087600 A1 Mar. 19, 2020

Related U.S. Application Data

(63) Continuation of application No. 16/111,261, filed on Aug. 24, 2018, now Pat. No. 10,696,931, which is a continuation of application No. 15/403,277, filed on Jan. 11, 2017, now Pat. No. 10,087,403.

(51) Int. Cl.

| | |
|---|---|
| ***C11D 11/00*** | (2006.01) |
| ***C11D 1/29*** | (2006.01) |
| ***C11D 1/22*** | (2006.01) |
| ***C11D 1/75*** | (2006.01) |
| ***C11D 3/37*** | (2006.01) |
| ***C11D 3/04*** | (2006.01) |
| ***C11D 1/37*** | (2006.01) |
| ***C11D 17/00*** | (2006.01) |

(52) U.S. Cl.

CPC ..... *C11D 11/0017* (2013.01); *C11D 1/22* (2013.01); *C11D 1/29* (2013.01); *C11D 1/37* (2013.01); *C11D 1/75* (2013.01); *C11D 3/046* (2013.01); *C11D 3/3723* (2013.01); *C11D 17/0008* (2013.01)

(58) Field of Classification Search

CPC ..... C11D 11/0017; C11D 1/22; C11D 1/29; C11D 1/37; C11D 3/046; C11D 3/3723

See application file for complete search history.

(56) References Cited

U.S. PATENT DOCUMENTS

| | | | | |
|---|---|---|---|---|
| 3,775,349 | A | 11/1973 | Tuvell et al. | |
| 6,251,844 | B1 | 6/2001 | Leonard et al. | |
| 6,410,498 | B1 | 6/2002 | Smets et al. | |
| 6,730,650 | B1 | 5/2004 | Wood | |
| 7,754,669 | B2 | 7/2010 | Bastigkeit et al. | |
| 7,994,369 | B2 | 8/2011 | Scheibel et al. | |
| 8,232,431 | B2 | 7/2012 | Price et al. | |
| 8,232,432 | B2 | 7/2012 | Scheibel et al. | |
| 8,940,677 | B2 * | 1/2015 | Boutique | C11D 3/386 510/276 |
| 9,127,238 | B2 * | 9/2015 | Man | A61K 8/84 |
| 9,493,725 | B2 | 11/2016 | Vinson et al. | |
| 9,493,726 | B2 * | 11/2016 | Vinson | C11D 3/38645 |
| 9,796,948 | B2 | 10/2017 | Shearouse et al. | |
| 9,850,452 | B2 * | 12/2017 | Fossum | C11D 1/22 |
| 2003/0134772 | A1 | 7/2003 | Dykstra et al. | |
| 2004/0018955 | A1 | 1/2004 | Wevers et al. | |
| 2011/0112005 | A1 | 5/2011 | Brooker et al. | |
| 2011/0152162 | A1 * | 6/2011 | Schneiderman | C11D 3/38663 510/340 |
| 2012/0258900 | A1 | 10/2012 | Adams et al. | |
| 2014/0094397 | A1 | 4/2014 | Guida et al. | |
| 2014/0287981 | A1 * | 9/2014 | Man | A61K 8/40 510/475 |
| 2014/0349913 | A1 | 11/2014 | Delaney et al. | |
| 2015/0030644 | A1 | 1/2015 | Oh et al. | |
| 2015/0322387 | A1 * | 11/2015 | Ohtani | A01N 31/16 424/408 |
| 2016/0312152 | A1 | 10/2016 | Borne et al. | |
| 2016/0340611 | A1 | 11/2016 | Scheibel et al. | |
| 2017/0253837 | A1 * | 9/2017 | Scheibel | C11D 17/003 |
| 2017/0369816 | A1 | 12/2017 | Holland et al. | |
| 2018/0171271 | A1 | 6/2018 | Skagerlind | |
| 2018/0195029 | A1 | 7/2018 | Delaney et al. | |
| 2018/0265825 | A1 | 9/2018 | Park | |
| 2019/0024026 | A1 | 1/2019 | Delaney | |

OTHER PUBLICATIONS

14630 Search Report for PCT application No. PCT/US2018/013290, dated Apr. 24, 2018, 12 pages.

P&G Case No. 14630C—All Office Actions, U.S. Appl. No. 16/111,261.

All Office Actions, U.S. Appl. No. 15/403,277, filed Jan. 11, 2017.

* cited by examiner

*Primary Examiner* — Necholus Ogden, Jr.

(57) ABSTRACT

Detergent compositions having surfactant systems that include alkyl ethoxylated sulfate surfactant (AES) and linear alkyl benzene sulfonate surfactant (LAS). Methods of treating fabric with such compositions.

17 Claims, 1 Drawing Sheet

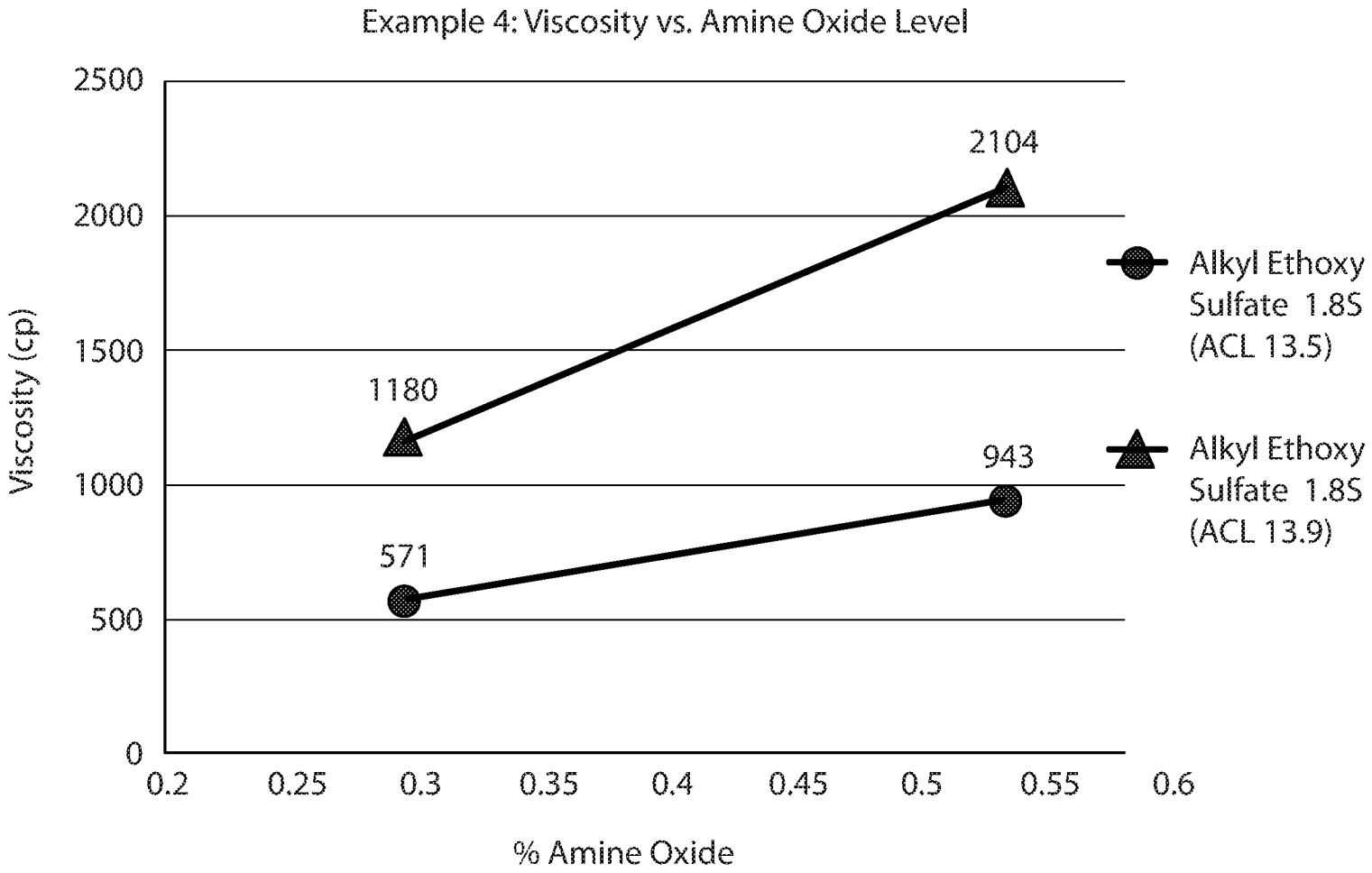
Example 4: Viscosity vs. Amine Oxide Level
Viscosity (cp)
2500
2000
1500
1000
500
0
0.2
0.25
0.3
0.35
0.4
0.45
0.5
0.55
0.6
% Amine Oxide
2104
1180
943
571
Alkyl Ethoxy Sulfate 1.8S (ACL 13.5)
Alkyl Ethoxy Sulfate 1.8S (ACL 13.9)

DETERGENT COMPOSITIONS HAVING SURFACTANT SYSTEMS

FIELD OF THE INVENTION

The present disclosure relates to detergent compositions having surfactant systems that include alkyl ethoxylated sulfate surfactant (AES) and linear alkyl benzene sulfonate surfactant (LAS). The present disclosure further relates to methods of treating fabric with such compositions.

BACKGROUND OF THE INVENTION

Liquid detergent compositions, for example laundry detergents, that have more than 20% surfactant tend to have relatively high viscosities due to the high amount of active ingredients in the compositions. When consumers pour these "thick" detergents into a dosing cup or washing vessel, the detergents are often viewed as being of high quality and/or able to provide high degrees of performance benefits.

Liquid detergent compositions that contain 20% of surfactant or less may also be of high quality, but due to the relatively lower level of active ingredients and/or high levels of water, they can appear runny or "thin" to consumers. Products that are runny do not provide the same luxurious pouring experience to consumers that are provided by "thicker" detergents, and may be associated with being "cheap" and/or low-performing.

Thickeners, such as external structurants or salts, may be added to detergent compositions to increase their viscosities. However, such thickeners tend to bring added cost without providing a performance benefit in the end use of the detergent composition.

There is a need for improved detergent compositions having desired viscosity and performance benefits.

SUMMARY OF THE INVENTION

The present disclosure relates to liquid detergent compositions. For example, the present disclosure relates to liquid detergent compositions that include a surfactant system, the surfactant system including alkyl ethoxylated sulfate surfactant (AES) and linear alkyl benzene sulfonate surfactant (LAS), where the alkyl portion of the AES includes, on average, from 13.9 to about 14.6 carbon atoms, where the AES has an average degree of ethoxylation of from 1 to 5.

The present disclosure also relates to liquid detergent compositions that include from a surfactant system, the surfactant system including alkyl ethoxylated sulfate surfactant (AES) and linear alkyl benzene sulfonate surfactant (LAS), where at least 50% of the AES includes an alkyl portion having 14 or more carbon atoms, where the AES has an average degree of ethoxylation of from 1 to 5.

The present disclosure also relates to methods of treating a fabric, where the method includes the step of contacting a fabric with the compositions of the present disclosure.

BRIEF DESCRIPTION OF THE DRAWINGS

The FIGURE submitted herewith shows a graphical representation of a portion of the data presented in Example 4.

DETAILED DESCRIPTION OF THE INVENTION

The present disclosure relates to liquid detergent compositions. The detergent compositions have relatively low levels of surfactant systems (e.g., from about 5% to about 20%, by weight of the compositions and may have relatively high levels of water. However, it has been surprisingly found that careful selection of the surfactants in the surfactant system can help to build viscosity in the compositions. By internally building viscosity with active ingredients, a well-performing detergent with desirable viscosity can be formulated in a cost-efficient manner.

The compositions and methods of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Detergent Composition

The present disclosure relates to liquid detergent compositions. The detergent composition may be a fabric care composition, including a heavy duty liquid (HDL) detergent, a light duty liquid (LDL) detergent, or a pre-treat composition.

The detergent composition is a liquid composition. The composition may be pourable. The composition may have a viscosity of from about 100 to about 2000 mPa*s, or from about 200 to about 1000 mPa*s, or from about 300 to about 800 mPa*s, at 20° C. and a shear rate of 20 $s^{-1}$. The composition may have a viscosity of greater than 500 cps, measured at 20 $s^{-1}$ and 20° C.

The composition may include at least about 50%, or at least about 60%, or at least about 70%, or at least about 75%, or at least about 80%, by weight of the composition, of water.

Liquid compositions according to the present disclosure may be made according to conventional methods, for example in a batch process or in a continuous loop process.

Surfactant System

The liquid detergent compositions of the present disclosure include surfactant systems. Surfactant systems according to the present disclosure provide improved thickening benefits, as well as performance benefits. Specifically, it has been found that careful selection of the type of surfactants, particularly the type of AES, as well as the ratio of the surfactants provides surprising viscosity benefits.

The compositions may include from about 5% to 20%, by weight of the composition, of a surfactant system. The composition may include from about 8% to about 18%, preferably about 10% to about 16%, by weight of the composition, of a surfactant system.

The surfactant systems of the present disclosure include a mixture of surfactants. The surfactant systems may comprise, at least, alkyl ethoxylated sulfate surfactant (AES) and linear alkyl benzene sulfonate surfactant (LAS). As mentioned above, careful selection of the type and ratio of these surfactants can provide surprising viscosity benefits.

The surfactant system may comprise alkyl ethoxylated sulfate surfactant (AES). The AES may include an alkyl portion, an ethoxylated portion, and a sulfate head group. The AES may be formed by providing an alcohol feedstock, such as an ethoxylated alcohol feedstock, and sulfating the alcohol. The alcohol and/or AES surfactant of the present disclosure may include mixtures of feedstocks from more than one source, for example two or more sources.

The AES surfactant may include a distribution of AES molecules having alkyl portions in a variety of lengths. Typically, the alkyl portion may range in length from 8 to 20 carbons, or from 10 to 18 carbons.

The AES of the present disclosure may include relatively long alkyl portions, making the AES molecules relatively hydrophobic. The alkyl portion of the AES may be linear or branched. It has been found that increasing the average length of the alkyl portion, even modestly, can have surprising effects on the viscosity of the composition. Without wishing to be bound by theory, it is believed that the more hydrophobic AES binds "free water" in the formula, thereby providing an increase in rheology.

The alkyl portion of the AES may include, on average, from 13.7 to about 16, or from about 13.9 to about 14.6, carbon atoms. At least about 50%, or at least about 60%, of the AES molecules may include an alkyl portion having 14 or more carbon atoms, preferably from 14 to 18, or from 14 to 17, or from 14 to 16, or from 14 to 15 carbon atoms.

The AES of the present disclosure may be characterized by an average degree of ethoxylation. The AES may have an average degree of ethoxylation of from about 1.5 to about 3, or from about 1.8 to about 2.5.

The compositions of the present disclosure may include from about 4% to about 15%, or from about 6% to about 12%, by weight of the composition, of AES. The surfactant systems of the present disclosure may include from about 40% to about 80%, or from about 50% to about 75%, by weight of the surfactant system, of AES.

The AES may be linear, branched, or combinations thereof. Typically, less than about 74%, or less than about 65%, or less than about 50%, or less than about 40%, or less than about 30%, or less than about 20%, or less than about 10%, or less than about 5% of the AES, by weight of the AES, is branched. High levels of branched AES may have an undesired and/or unpredictable effect on rheology.

Suitable AES according to the present disclosure may be synthesized from feedstocks having a suitable hydrophobe, such as alkyl alcohol feedstocks. The feedstocks may be natural and/or synthetic feedstocks. The feedstocks may be linear, branched, or combinations thereof. The feedstocks may be derived from vegetable oils such as coconut and palm kernel. The feedstocks may be branched alcohols, for example 2-alkyl branched alcohols (as hydrophobes) that have branching, e.g., 100% branching, at the C2 position (C1 is the carbon atom that is or will be covalently attached to the alkoxylated sulfate moiety). 2-alkyl branched alcohols, e.g., 2-alkyl-1-alkanols or 2-alkyl primary alcohols, which may be derived from the oxo process, are commercially available from Sasol, e.g., LIAL® and/or ISALCHEM® (which is prepared from LIAL® alcohols by a fractionation process), and/or from Shell, e.g. Neodols® (which may be prepared via a modified oxo process). The branched alcohols may be mid chain branched with one or more $C_1$-$C_4$ alkyl moieties branched on the longer linear chain, or branched alcohols with a methyl branch randomly distributed along the hydrophobe chain. In some examples, the branched alcohols may contain cyclic moieties. Feedstocks, such as alkyl alcohols, may be ethoxylated and/or sulfonated according to known methods. The surfactant systems of the present disclosure may include linear alkyl benzene sulfonate surfactant (LAS). The LAS may have an average chain length of from about 10 to about 16 carbon atoms, more preferably from about 11 to about 14 carbon atoms, even more preferably about 11.8.

The compositions of the present disclosure may include from about 1% to about 7%, or from about 2% to about 6%, by weight of the composition, of LAS. The surfactant systems of the present disclosure may include from about 5% to about 40% or from about 10% to about 30%, by weight of the surfactant system, of LAS.

Suitable alkyl benzene sulphonate (LAS) may be obtained by sulphonating commercially available linear alkyl benzene (LAB). Suitable LAB includes low 2-phenyl LAB, such as those supplied by Sasol under the tradename Isochem® or those supplied by Petresa under the tradename Petrelab®. Other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as hydrofluoric-acid-catalyzed (HF-catalyzed) routes, may also be suitable.

The AES and LAS of the present disclosure may be present in a weight ratio. The composition may include, by weight, more AES than LAS. The AES and the LAS may be present in a weight ratio of from about 1.5:1 to about 5:1, or from about 2:1 to about 4:1, or from about 3:1 to about 4:1. Optimizing the weight ratio of AES to LAS can have a beneficial effect on increasing viscosity of the composition.

In addition to AES and LAS, the surfactant systems of the present disclosure may include other surfactants. The surfactant system may further comprise a detersive surfactant selected from anionic surfactants, nonionic surfactants, cationic surfactants, zwitterionic surfactants, amphoteric surfactants, ampholytic surfactants, and mixtures thereof. The surfactant system may comprise nonionic surfactant (such as ethoxylated alcohol), amine oxide, or mixtures thereof.

The surfactant system may include nonionic surfactant. Suitable nonionic surfactants include alkoxylated fatty alcohols, such as ethoxylated fatty alcohols. Other suitable nonionic surfactants include alkoxylated alkyl phenols, alkyl phenol condensates, mid-chain branched alcohols, mid-chain branched alkyl alkoxylates, alkylpolysaccharides (e.g., alkylpolyglycosides), polyhydroxy fatty acid amides, ether capped poly(oxyalkylated) alcohol surfactants, and mixtures thereof. The alkoxylate units may be ethyleneoxy units, propyleneoxy units, or mixtures thereof. The nonionic surfactants may be linear, branched (e.g., mid-chain branched), or a combination thereof. Specific nonionic surfactants may include alcohols having an average of from about 12 to about 16 carbons, and an average of from about 3 to about 9 ethoxy groups, such as C12-C14 EO7 nonionic surfactant. The compositions may include from about 0.1%, or from about 0.2%, or from about 0.3%, to about 5%, or to about or to about 4%, or to about 3%, or to about 2%, or to about 1%, by weight of the composition, of nonionic surfactant.

The surfactant systems of the present disclosure may include amine oxide. It has been found that amine oxide in combination with hydrophobic AES and LAS as described above is surprisingly efficient at building viscosity. Suitable amine oxide surfactants include C10-C18 alkyl dimethyl amine oxide, and C10-18 acylamido alkyl dimethyl amine oxide.

The compositions may include from about 0.1%, or from about 0.2%, or from about 0.3%, to about 2%, or to about 1.5%, or to about 1%, or to about 0.8%, or to about 0.6%, by weight of the composition, of amine oxide. The composition may include from about 0.3% to about 0.6%, by weight of the composition, of amine oxide.

The surfactant system may be substantially free, for example less than 1% by weight of the composition, of anionic mid-chain branched surfactants, such as mid-chain branched sulfates and/or mid-chain branched sulfonates.

Viscosity-Reducing Polymer

The surfactant systems of the present disclosure are typically selected to provide a desirable viscosity profile in the final composition. However, the rheology may still need to be tweaked in order to balance performance and viscosity. Organic solvents or water may be employed to further adjust viscosity, but it may be more desirable to use an agent that both adjusts viscosity but also provides performance benefits in the intended end-use of the composition.

Thus, the compositions of the present disclosure may include a viscosity-reducing polymer. As used herein, a viscosity-reducing polymer is a polymer that decreases the viscosity of a composition when present compared to the viscosity of the same composition when the viscosity-reducing polymer is not present. The viscosity-reducing polymer may provide performance benefits in the intended end-use of the composition. The composition may include from about 0.1%, or from about 0.3%, or from about 0.5%, or from about 0.7%, or from about 1%, to about 5%, or to about 4%, or to about 3%, or to about 2%, or to about 1%, by weight of the composition, of a viscosity-reducing polymer.

The viscosity-reducing polymer may be an alkoxylated polyalkyleneimine polymer. The alkxoylated polyalkylenimine may be linear, branched, or combinations thereof, preferably branched.

Typically, the alkoxylated polyalkyleneimine polymer comprises a polyalkyleneimine backbone. The polyalkyleneimine may comprise C2 alkyl groups, C3 alkyl groups, or mixtures thereof, preferably C2 alkyl groups. The alkoxylated polyalkyleneimine polymer may have a polyethyleneimine ("PEI") backbone.

The alkoxylated PEI may comprise a polyethyleneimine backbone having a weight average molecular weight of from about 400 to about 1000, or from about 500 to about 750, or from about 550 to about 650, or about 600, as determined prior to ethoxylation.

The PEI backbones of the polymers described herein, prior to alkoxylation, may have the general empirical formula:

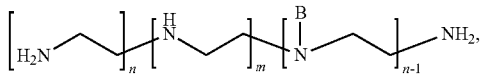

where B represents a continuation of this structure by branching. In some aspects, n+m is equal to or greater than 8, or 10, or 12, or 14, or 18, or 22.

The alkoxylated polyalkyleneimine polymer comprises alkoxylated nitrogen groups. The alkoxylated polyalkyleneimine polymer may independently comprise, on average per alkoxylated nitrogen, up to about 50, or up to about 40, or up to about 35, or up to about 30, or up to about 25, or up to about 20, alkoxylate groups. The alkoxylated polyalkyleneimine polymer may independently comprise, on average per alkoxylated nitrogen, at least about 5, or at least about 10, or at least about 15, or at least about 20, alkoxylate groups.

The alkoxylated polyalkyleneimine polymer, preferably alkoxylated PEI, may comprise ethoxylate (EO) groups, propoxylate (PO) groups, or combinations thereof. The alkoxylated polyalkyleneimine polymer, preferably alkoxylated PEI, may comprise ethoxylate (EO) groups. The alkoxylated polyalkyleneimine polymer, preferably alkoxylated PEI, may be free of propoxylate (PO) groups.

The alkoxylated polyalkyleneimine polymer, preferably alkoxylated PEI, may comprise on average per alkoxylated nitrogen, about 1-50 ethoxylate (EO) groups and about 0-5 propoxylate (PO) groups. The alkoxylated polyalkyleneimine polymer, preferably alkoxylated PEI, may comprise on average per alkoxylated nitrogen, about 1-50 ethoxylate (EO) groups and is free of propoxylate (PO) groups. The alkoxylated polyalkyleneimine polymer, preferably alkoxylated PEI, may comprise on average per alkoxylated nitrogen, about 10-30 ethoxylate (EO) groups, preferably about 15-25 ethoxylate (EO) groups.

Suitable alkoxylated polyalkylenimine polymers may include propoxylated polyalkylenimine (e.g., PEI) polymers. The propoxylated polyalkylenimine (e.g., PEI) polymers may also be ethoxylated. The propoxylated polyalkylenimine (e.g., PEI) polymers may have inner polyethylene oxide blocks and outer polypropylene oxide blocks, the degree of ethoxylation and the degree of propoxylation not going above or below specific limiting values. The ratio of polyethylene blocks to polypropylene blocks (n/p) may be from about 0.6, or from about 0.8, or from about 1, to a maximum of about 10, or a maximum of about 5, or a maximum of about 3. The n/p ratio may be about 2. The propoxylated polyalkylenimines may have PEI backbones having molecular weights (prior to alkoxylation) of from about 200 g/mol to about 1200 g/mol, or from about 400 g/mol to about 800 g/mol, or about 600 g/mol. The molecular weight of the propoxylated polyalkylenimines may be from about 8,000 to about 20,000 g/mol, or from about 10,000 to about 15,000 g/mol, or about 12,000 g/mol.

Suitable propoxylated polyalkylenimine polymers may include compounds of the following structure:

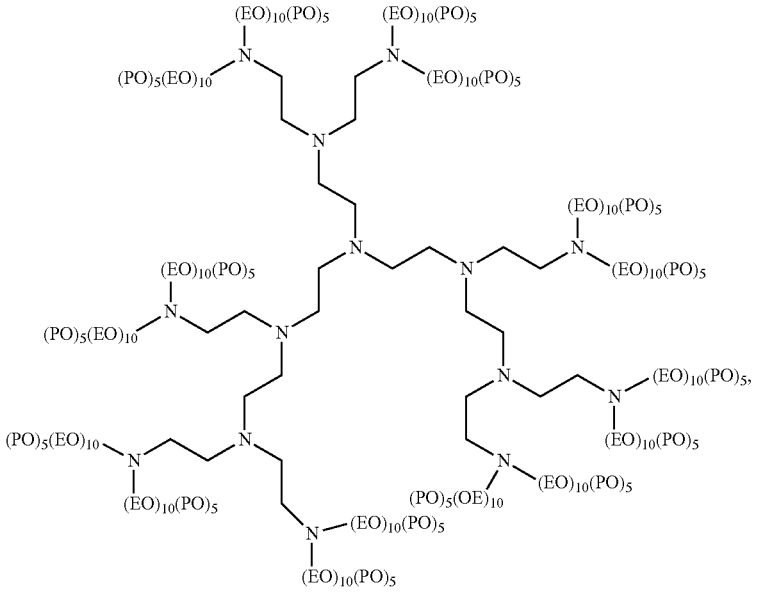

where EOs are ethoxylate groups and POs are propoxylate groups. The compound shown above is a PEI where the molar ratio of EO:PO is 10:5 (e.g., 2:1). Other similar, suitable compounds may include EO and PO groups present in a molar ratio of about 10:5 or about 24:16.

Suitable polymers include low molecular weight, water soluble, and lightly alkoxylated ethoxylated/propoxylated polyalkyleneamine polymers. By "lightly alkoxylated," it is meant the polymers of this invention average from about 0.5 to about 20, or from 0.5 to about 10, alkoxylations per nitrogen. The polyamines may be "substantially non-charged," meaning that there are no more than about 2 positive charges for every about 40 nitrogens present in the backbone of the polyalkyleneamine polymer at pH 10, or at pH 7; it is recognized, however, that the charge density of the polymers may vary with pH.

Suitable alkoxylated polyalkyleneimines, such as PEI600 EO20 and/or PEI 600 EO24 PO16, are available from BASF (Ludwigshafen, Germany).

Other Ingredients

As described in more detail below, the compositions of the present disclosure may include, or may substantially exclude, certain ingredients.

The compositions of the present disclosure may include one or more detergent adjuncts. Suitable detergent adjuncts may include fatty acids and/or salts thereof, enzymes, encapsulated benefit agents such as encapsulated perfume, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, or mixtures thereof. The compositions may be free of CBD-transferase (i.e., Cellulose Binding Domain transferase). Typical usage levels of suitable adjuncts range from as low as 0.001% by weight of composition for adjuncts such as optical brighteners to 50% by weight of composition for builders. One of ordinary skill can select appropriate levels for a given intended use.

As the surfactant systems are selected to provide thickening benefits to the compositions described herein, the compositions may have very low levels, or even be substantially free of, inorganic salts, external structurants, and/or other thickening agents. These components may provide little to no cleaning or treatment benefit in the final product.

Inorganic salts are known to increase the viscosity of liquid detergent compositions. Such inorganic salts include alkali metals or alkali earth metals of chlorides and/or carbonates, such as sodium chloride or sodium carbonate. The compositions of the present disclosure may comprise less than about 2%, or less than about 1.5%, or less than about 1%, or less than about 0.5%, or less than about 0.25%, or less than about 0.1%, by weight of the composition, of inorganic salt. The compositions of the present disclosure may be substantially free of inorganic salts.

The composition may be substantially free of external structurant (e.g., less than 1%, less than 0.1%, or even 0%, by weight of the composition). External structurants include non-polymeric crystalline, hydroxy-functional structurants and/or polymeric structurants.

Non-polymeric crystalline, hydroxyl functional structurants may comprise a crystallizable glyceride, which may be pre-emulsified to aid dispersion into the final detergent composition. Suitable crystallizable glycerides include hydrogenated castor oil or "HCO" or derivatives thereof, provided that it is capable of crystallizing in the liquid detergent composition.

Polymeric structurants may include naturally derived structurants and/or synthetic structurants. Naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Synthetic polymeric structurants include: polycarboxylates, polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Such copolymers are available from Noveon Inc. under the tradename Carbopol® Aqua 30.

Methods of Making the Detergent Composition

The present disclosure relates to methods of making detergent compositions. The method may include combining the components of the compositions described herein in the proportions described.

For example, the method may comprise the steps of: combining alkyl ethoxylated sulfate surfactant (AES) and linear alkyl benzene sulfonate surfactant (LAS) to form a surfactant system, where the alkyl portion of the AES includes, on average, from 13.7 to about 16 carbon atoms, where the AES has an average degree of ethoxylation of from 1 to 5, and where the AES and the LAS are present in a weight ratio of from about 1.5:1 to about 5:1; combining the surfactant system with one or more detergent adjuncts to form a detergent composition, where the detergent composition comprises from about 5% to about 20%, by weight of the composition, of the surfactant system. The detergent composition may further comprise a viscosity-reducing polymer (e.g., an alkoxylated PEI) as described herein.

The components of the detergent compositions of the present disclosure may be combined according to conventional methods, for example in a batch process or in a continuous loop process.

Methods of Using the Detergent Composition

The present disclosure relates to a method of treating a fabric, the method comprising the step of contacting a fabric with a detergent composition described herein. The method may further comprise the step of carrying out a washing or cleaning operation. Water may be added before, during, or after the contacting step to form a wash liquor. The composition may be used to pre-treat a fabric, for example by apply the neat composition directly to a fabric prior to placing the composition into a washing vessel such as an automatic washing machine.

The present disclosure also relates to a process for the washing, for example by machine, of fabric, preferably soiled fabric, using a composition according to the present disclosure, comprising the steps of, placing a detergent composition according to the present disclosure into contact with the fabric to be washed, and carrying out a washing or cleaning operation.

Any suitable washing machine may be used, for example, a top-loading or front-loading automatic washing machine. Those skilled in the art will recognize suitable machines for the relevant wash operation. The article of the present disclosure may be used in combination with other compositions, such as fabric additives, fabric softeners, rinse aids, and the like. Additionally, the detergent compositions of the present disclosure may be used in known hand washing methods.

The present disclosure may also be directed to a method of treating a fabric, the method comprising the steps of contacting a fabric with a detergent composition described herein, carrying out a washing step, and then contacting the fabric with a fabric softening composition. The entire method, or at least the washing step, may be carried out by hand, be machine-assisted, or occur in an automatic washing machine. The step of contacting the fabric with a fabric softening composition may occur in the presence of water, for example during a rinse cycle of an automatic washing machine.

COMBINATIONS

Specifically contemplated combinations of the disclosure are herein described in the following lettered paragraphs. These combinations are intended to be illustrative in nature and are not intended to be limiting.

A. A liquid detergent composition comprising: from about 5% to 20%, by weight of the composition, of a surfactant system, the surfactant system comprising alkyl ethoxylated sulfate surfactant (AES) and linear alkyl benzene sulfonate surfactant (LAS), wherein the alkyl portion of the AES includes, on average, from 13.7 to about 16 carbon atoms, wherein the AES has an average degree of ethoxylation of from 1 to 5, and wherein the AES and the LAS are present in a weight ratio of from about 1.5:1 to about 5:1.

B. A liquid detergent composition according to paragraph A, wherein the composition comprises from about 8% to about 18%, preferably about 10% to about 16%, by weight of the composition, of a surfactant system.

C. A liquid detergent composition according to any of paragraphs A-B, wherein the alkyl portion of the AES includes, on average, from about 13.9 to about 14.6 carbon atoms.

D. A liquid detergent composition according to any of paragraphs A-C, wherein the AES has an average degree of ethoxylation of from about 1.5 to about 3, or from about 1.8 to about 2.5.

E. A liquid detergent composition according to any of paragraphs A-D, wherein the AES and the LAS are present in a weight ratio of from about 2:1 to about 4:1, preferably from about 3:1 to about 4:1.

F. A liquid detergent composition according to any of paragraphs A-E, wherein the composition comprises less than about 2%, by weight of the composition, of an inorganic salt.

G. A liquid detergent composition according to any of paragraphs A-F, wherein the composition is substantially free of external structurants, wherein the external structurants are selected from the group consisting of polymeric structurants, non-polymeric crystalline hydroxy-functional structurants, and combinations thereof.

H. A liquid detergent composition according to any of paragraphs A-G, wherein the composition has a viscosity of greater than 500 cps, measured at 20 $s^{-1}$ and 20° C.

I. A liquid detergent composition according to any of paragraphs A-H, wherein the composition includes less than 1% of anionic mid-chain branched surfactant.

J(1). A liquid detergent composition according to any of paragraphs A-I, wherein the surfactant system further comprises nonionic surfactant, amine oxide, or mixtures thereof.

J(2). A liquid detergent composition according to any of paragraphs A-J(1), wherein the surfactant system comprises amine oxide.

J(3). A liquid detergent composition according to any of paragraphs A-J(2), wherein the surfactant system comprises from about 0.1% to about 2%, preferably from about 0.2% to about 1%, more preferably from about 0.3% to about 0.6%, by weight of the composition, of amine oxide.

K. A liquid detergent composition according to any of paragraphs A-J(3), wherein the composition further comprises a detergent adjunct selected from the group consisting of fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, and mixtures thereof.

L. A liquid detergent composition according to any of paragraphs A-K, wherein the composition further comprises at least about 50%, or at least about 60%, or at least about 70%, or at least about 75%, or at least about 80%, by weight of the composition, of water.

M. A liquid detergent composition according to any of paragraphs A-L, wherein the composition further comprises from about 0.5% to about 5% of a viscosity-reducing polymer.

N. A liquid detergent composition according to any of paragraphs A-M, wherein the viscosity-reducing polymer is an alkoxylated polyalkyleneimine.

O. A liquid detergent composition according to any of paragraphs A-N, wherein the alkoxylated polyalkyleneimine is a polyethyleneimine (PEI) comprising inner polyethylene oxide blocks and outer polypropylene oxide blocks, where the ratio of polyethylene oxide blocks to polypropylene oxide blocks (n/p) is from about 1 to about 5.

P. A liquid detergent composition comprising: from about 5% to 20%, by weight of the composition, of a surfactant system, the surfactant system comprising alkyl ethoxylated sulfate surfactant (AES) and linear alkyl benzene sulfonate surfactant (LAS), wherein at least 50% of the AES includes an alkyl portion having from 14 to 18 carbon atoms, wherein the AES has an average degree of ethoxylation of from 1 to 5, and wherein the AES and the LAS are present in a weight ratio of from about 1.5:1 to about 5:1, preferably from about 2:1 to about 4:1.

Q. A liquid detergent composition according to paragraph P, wherein at least 60% of the AES includes an alkyl portion having 14 or more carbon atoms.

R. A liquid detergent composition according to any of paragraphs P-Q, wherein the AES has an average degree of ethoxylation of from about 1.5 to about 3, or from about 1.8 to about 2.5.

S. A liquid detergent composition according to any of paragraphs P-R, wherein the AES and the LAS are present in a weight ratio of from about preferably from about 2:1 to about 4:1, preferably from about 3:1 to about 4:1.

T. A liquid detergent composition according to any of paragraphs P-S, wherein the surfactant system further comprises nonionic surfactant, amine oxide, or mixtures thereof, preferably amine oxide, more preferably from about 0.1% to about 2%, by weight of the composition, of amine oxide.

U. A liquid detergent composition according to any of paragraphs P-T, wherein the composition comprises less than about 2%, by weight of the composition, of an inorganic salt.

V. A liquid detergent composition according to any of paragraphs P-U, wherein the composition has a viscosity of greater than 500 cps, measured at 20 $s^{-1}$ and 20° C.

W. A liquid detergent composition according to any of paragraphs P-V, wherein the composition further comprises a detergent adjunct selected from the group consisting of fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, and mixtures thereof.

X. A liquid detergent composition according to any of paragraphs P-W, wherein the composition further comprises at least about 50%, or at least about 60%, or at least about 70%, or at least about 75%, or at least about 80%, by weight of the composition, of water.

Y. A liquid detergent composition according to any of paragraphs P-X, wherein the composition comprises a polyethyleneimine (PEI) polymer comprising inner polyethylene oxide blocks and outer polypropylene oxide blocks, where the ratio of polyethylene oxide blocks to polypropylene oxide blocks (n/p) is from about 1 to about 5.

Z. A method of treating a fabric, the method comprising the step of contacting a fabric with the composition of any preceding paragraph.

TEST/CALCULATION METHODS

The following section describes the test/calculation methods used in the present disclosure.

Viscosity

A composition's viscosity is measured according to the following procedure.

The rheological profile of a liquid detergent composition is assessed via so-called shear sweep flow continuous ramp method at ascending shear rates from an initial shear rate of 0.1 inverse seconds (1/s) to a final shear rate of 1200 inverse seconds (1/s) at a constant temperature of 20° C. The instrument for the measurement is a programmable Rheom eter (i.e., TA instruments AR2000®) with Peltier plate, heating rate capacity of 20° C. per minute, minimum precision of 0.1° C., and standard temperature range of 0-200° C. This instrument uses a spindle and 40 mm 2° steel cone plate arrangement with truncation height of 1000 μm. A pre-shear conditioning step is performed at 10 l/s for 10 seconds, and the sample is allowed to equilibrate for 1 minute prior to performing the actual shear sweep test. Typical shear sweep phase duration is 3 minutes with data logged at 32 points per decade.

Results may be reported at 0.2 and 20 inverse seconds and graphically via XY scatter chart with X axis having a logarithmic scale. In particular, results may be reported at 20 $s^{-1}$ at 20° C.

Determination of the Average Alkyl Chain Length

The average alkyl chain length of a surfactant, or of a precursor alcohol, is often reported by surfactant suppliers. One of ordinary skill will understand that average alkyl chain length of a sulfated or sulfonated surfactant may be determined and/or reported in terms of the feedstock alcohol.

In the case that only the chain length distribution on a mass basis is reported, the average alkyl chain length can be calculated by the following equation:

$$\text{Average Alkyl Chain length}=(\Sigma CL_i)/(\Sigma(X_i/CL_i))$$

where $X_i$ is the mass fraction of each chain length, $CL_i$.

If the chain length distribution is not available from the surfactant supplier, the chain length distribution can be determined via Gas Chromatography as described in Analysis of Surfactants, Second Edition Thomas Schmitt, CRC Press, 2001, pg. 29.

Determination of Average Degree of Ethoxylation

With regard to surfactants, the average degree of ethoxylation on a molar basis (Moles EO/Moles Alcohol) is often reported by surfactant suppliers. Even when a surfactant is sulfated or sulfonated, one of ordinary skill understands that degree of ethoxylation may be determined and/or reported in terms of the feedstock alcohol.

The average degree of ethoxylation on a molar basis can also be calculated in the following way. First, the hydroxyl value of the starting alcohol and of the alcohol ethoxylate are determined via ASTM E1899. Then, the average moles of EO are calculated by the follow equation:

Average moles of EO=(56,100/Hydroxyl Value Alcohol Ethoxylate−56,100/Hydroxyl Value Starting Alcohol)/44

EXAMPLES

The examples provided below are intended to be illustrative in nature and are not intended to be limiting. Amounts provided are in percent by weight of the total composition, unless provided otherwise.

Example 1. Chain Length Distributions

Exemplary AES surfactants (A-I) are provided in Table 1, wherein each surfactant comprises a mixture of AES molecules having a distribution of chain lengths. The average chain length for each surfactant is also provided. Surfactants A-D are comparative surfactants, and surfactants E-H are surfactants according to the present disclosure.

The AES surfactants may be made by sulfating feedstock ethoxylated alcohols having the same chain lengths as described below. Note that Examples E and F have the same average chain length, but the AES surfactants in each sample have different distributions of chain lengths. Amounts provided are by weight of total surfactant.

TABLE 1

| | AES Surfactant | | | | | | | | |
|---|---|---|---|---|---|---|---|---|---|
| Chain Length (CL) | A (comp.) | B (comp.) | C (comp.) | D (comp.) | E | F | G | H | I |
| C11, % wt. | 0.0 | 0.0 | 0.1 | 0.3 | 0.0 | 0.0 | 0.0 | 0.0 | 0.0 |
| C12, % wt. | 67.0 | 33.0 | 34.0 | 24.1 | 13.0 | 0.0 | 4.0 | 0.0 | 0.0 |
| C13, % wt. | 0.0 | 31.0 | 20.6 | 25.6 | 14.0 | 13.0 | 6.0 | 0.6 | 0.0 |
| C14, % wt. | 26.0 | 19.0 | 23.9 | 24.4 | 36.0 | 82.0 | 44.0 | 48.3 | 2.5 |
| C15, % wt. | 0.0 | 16.0 | 19.7 | 25.3 | 36.5 | 5.0 | 46.0 | 50.5 | 95.0 |
| C16, % wt. | 6.0 | 1.0 | 1.4 | 0.3 | 0.5 | 0.0 | 0.0 | 0.6 | 2.5 |
| C17, % wt. | 0.0 | 0.0 | 0.0 | 0.0 | 0.0 | 0.0 | 0.0 | 0.0 | 0.0 |
| C18, % wt. | 1.0 | 0.0 | 0.2 | 0.0 | 0.0 | 0.0 | 0.0 | 0.0 | 0.0 |
| Average CL | 12.7 | 13.1 | 13.2 | 13.4 | 13.9 | 13.9 | 14.3 | 14.5 | 15.0 |

Example 2: Sample Formulations and Viscosity Data (AES:LAS Ratio of about 4:1)

The compositions of Table 2 are prepared and viscosity is measured as described in the Test Methods section. Examples 1-3 (10% total surfactant) and 4-5 (15% total surfactant), have similar compositions, respectively, but for AES of different average chain lengths; Examples 1 and 4 are comparative examples. The ratio of AES to LAS for each of Examples 1-5 is about 4:1.

TABLE 2

| | Ex 1 (comp.) | Ex 2 | Ex 3 | Ex 4 (comp.) | Ex 5 |
|---|---|---|---|---|---|
| Alkyl Ethoxy Sulfate 1.8S (avg. chain length: 13.5) | 7.72 | | | 11.51 | |
| Alkyl Ethoxy Sulfate 1.8S (avg. chain length: 13.9) | | 7.72 | | | 11.51 |
| Alkyl Ethoxy Sulfate 1.8S (avg. chain length: 14.5) | | | 7.72 | | |
| Linear Alkyl Benzene Sulfonate | 1.90 | 1.90 | 1.90 | 2.83 | 2.83 |
| Amine Oxide | 0.56 | 0.56 | 0.56 | 0.83 | 0.83 |
| C12-18 Fatty Acid | — | — | — | — | — |
| Borax | 1.35 | 1.35 | 1.35 | 2.01 | 2.01 |
| PEI600 EO20 | 0.32 | 0.32 | 0.32 | 0.47 | 0.47 |
| PEI600 EO24 PO16 | — | — | — | — | — |
| Brightener | 0.05 | 0.05 | 0.05 | 0.08 | 0.08 |
| Solvent | 3.50 | 3.50 | 3.50 | 5.21 | 5.21 |
| Minors (e.g., builder/chelant, formate, buffers/neutralizers, perfume) | 4.51 | 4.51 | 4.51 | 3.87 | 3.87 |

TABLE 2-continued

| | Ex 1 (comp.) | Ex 2 | Ex 3 | Ex 4 (comp.) | Ex 5 |
|---|---|---|---|---|---|
| Water | | | balance | | |
| pH | 8.4 | 8.4 | 8.4 | 8.4 | 8.4 |
| AES/LAS Ratio | 4.0 | 4.0 | 4.0 | 4.0 | 4.0 |
| AES Average Chain Length | 13.5 | 13.9 | 14.5 | 13.5 | 13.9 |
| Total Surfactant | 10 | 10 | 10 | 15 | 15 |
| Viscosity in mPa · s (20/s @20° C.) | 1298 | 1932 | 5514 | 955 | 1626 |

As shown in Table 2, increasing the average chain length of the AES from 13.5 to 13.9 or greater increases the viscosity of the composition.

Example 3: Sample Formulations and Viscosity Data (AES:LAS Ratio of about 1.6:1)

The compositions of Table 3 are prepared and viscosity is measured as described in the Test Methods section. Examples 6-7 (19% total surfactant) have similar compositions, but for AES of different average chain lengths; Example 6 is a comparative example. The ratio of AES to LAS for each of Examples 6 and 7 is about 1.6:1. Example 8 shows another exemplary composition according to the present disclosure (AES:LAS=2:1). Examples 9 and 10 are comparative formulations having 34% total surfactant.

TABLE 3

| | Ex 6 (comp.) | Ex 7 | Ex 8 | Ex 9 (comp.) | Ex 10 (comp.) |
|---|---|---|---|---|---|
| Alkyl Ethoxy Sulfate 1.8S (avg. chain length: 13.5) | 11.17 | | | 20.44 | |
| Alkyl Ethoxy Sulfate 1.8S (avg. chain length: 13.9) | | 11.17 | 6.41 | | 20.44 |
| Alkyl Ethoxy Sulfate 1.8S (avg. chain length: 14.5) | | | | | |
| Linear Alkyl Benzene Sulfonate | 6.90 | 6.90 | 3.21 | 11.91 | 11.91 |
| Amine Oxide | 0.66 | 0.66 | 0.56 | 1.21 | 1.21 |
| C1218 Fatty Acid | 0.88 | 0.88 | | 1.60 | 1.60 |
| Borax | 0.96 | 0.96 | 1.35 | 1.76 | 1.76 |
| PEI600 EO20 | 1.51 | 1.51 | 0.32 | | |
| PEI600 EO24 PO16 | 1.32 | 1.32 | | 2.41 | 2.41 |
| Brightener | 0.18 | 0.18 | 0.05 | 0.33 | 0.33 |
| Solvent | 5.60 | 5.60 | 3.50 | 6.00 | 6.00 |
| Minors (e.g., builder/chelant, formate, buffers/neutralizers, perfume) | 4.08 | 4.08 | 4.51 | 10.61 | 10.61 |
| Water | | | balance | | |
| pH | 8.3 | 8.3 | 8.4 | 8.3 | 8.3 |
| AES/LAS Ratio | 1.6 | 1.6 | 2.0 | 1.6 | 1.6 |
| AES Average Chain Length | 13.5 | 13.9 | 13.9 | 13.5 | 13.9 |
| Total Surfactant | 19 | 19 | 10 | 34 | 34 |
| Viscosity in mPa · s (20/s @20° C.) | 459 | 516 | 843 | 341 | 368 |

As shown in Table 3, the viscosity of Example 7 is greater than the viscosity of comparative Example 6, believed to be due to the AES having greater chain length. As also shown in Table 3, at higher surfactant levels, the viscosity change provided by increasing the average chain length of the AES is not as dramatic as at lower surfactant levels; see Examples 9 and 10.

Example 4: AES Chain Length, Amine Oxide, and Viscosity

In the following examples, different amounts of amine oxide surfactant are added to compositions having AES of differing chain lengths, and differences in viscosity are observed. The tested formulations are shown in Table 4. Examples 11 and 12 are comparative examples that include AES having an average chain length of 13.5 carbons, while Examples 13-14 are according to the present disclosure and include AES having an average chain length of 13.9 carbons.

In this particular example, viscosity is assessed via a "cup and bob" rotational viscometry method at a constant shear rate, at a constant temperature of 21.1° C. The instrument for the measurement is a programmable viscometer (i.e., Brookfield RVDV-II+ Programmable Viscometer) with heating/cooling bath, minimum precision of +/−0.5° C. Spindle and speed/rpm is chosen to give a reading near the center of the torque scale (approximately 50%), as shown on the digital readout, typically spindle 21 and 12-60 rpm. The torque generated by rotating a spindle under specified conditions in a test liquid is converted via an instrument constant to give a measure of shear viscosity in centipoise (cP) units. Once sample is loaded into cup, it is ensured that the sample is completely de-aerated and allowed to equilibrate to the specified temperature (21.1° C.+/−0.5° C.). The motor is turned on and allowed to run for 5 minutes before the viscosity reading is recorded. Results are reported in centipoise (cP), and the chosen speed (rpm) is provided below the viscosity reading.

TABLE 4

| | Ex 11 (comp.) | Ex 12 (comp.) | Ex 13 | Ex 14 |
|---|---|---|---|---|
| Alkyl Ethoxy Sulfate 1.8S (avg. chain length: 13.5) | 6.36 | 6.14 | | |
| Alkyl Ethoxy Sulfate 1.8S (avg. chain length: 13.9) | | | 6.34 | 6.14 |
| Linear Alkyl Benzene Sulfonate | 1.6 | 1.5 | 1.6 | 1.5 |
| Amine Oxide | 0.30 | 0.55 | 0.30 | 0.55 |
| C12-18 Fatty Acid | — | — | — | — |
| Borax | 1.05 | 1.02 | 0.52 | 0.50 |
| PEI600 EO20 | — | — | — | — |
| PEI600 EO24 PO16 | — | — | — | — |
| Brightener | 0.04 | 0.04 | 0.03 | 0.03 |
| Solvent | 2.9 | 2.8 | 2.6 | 2.5 |
| Minors (e.g., builder/chelant, formate, buffers/neutralizers, perfume) | 4.08 | 4.01 | 4.75 | 4.66 |
| Water | | Balance | | |
| pH | 8.5 | 8.5 | 8.6 | 8.6 |
| AES/LAS Ratio | 4 | 4 | 4 | 4 |
| AES Average Chain Length | 13.5 | 13.5 | 13.9 | 13.9 |
| Total Surfactant | 8.2 | 8.2 | 8.2 | 8.2 |
| Viscosity in cP (approx. 50% torque; 21.1° C.) | 571 (50 rpm) | 943 (20 rpm) | 1180 (30 rpm) | 2104 (12 rpm) |
| Slope | Slope 1 = 1488 | | Slope 2 = 3696 | |

The FIGURE submitted herewith is a graph showing how the concentration of amine oxide affects viscosity in each pair of compositions (C13.5 AES vs. C13.9 AES). The slope of each line in the FIGURE is also provided in Table 4; Slope 1 (1488) is the slope of the line formed from Examples 11 and 12, and Slope 2 (3696) is the slope of the lined formed from Examples 13 and 14. The slope of each line relates to the relative rates of viscosity increase in each pair of examples. Notably, Slope 2 is approximately 1.5 times (i.e., 150%) greater than Slope 1 ((3696-1488)/1488).

In sum, the data in Table 4 and the FIGURE show that the rate of viscosity increase as a function of amine oxide level is approximately 1.5 times (150%) greater in the compositions having AES with the greater chain length (C13.9 vs. C13.5). This indicates that the compositions according to the present disclosure that have AES of greater chain lengths can be thickened more efficiently with amine oxide (which also provides performance benefits in the end-use of such compositions) compared to the comparative compositions.

Example 5: Effect of Certain Polymers on Viscosity

A base composition having the formulation (in parts per 100 parts of base composition) shown in Table 5A is provided; the composition is similar to Ex. 3 in Table 2 above.

TABLE 5A

| Base composition (in parts per 100 parts of base composition) | |
|---|---|
| Alkyl Ethoxy Sulfate 1.8S (avg. chain length: 14.5) | 7.72 |
| Linear Alkyl Benzene Sulfonate | 1.90 |
| Amine Oxide | 0.56 |
| C12-18 Fatty Acid | — |
| Borax | 1.35 |
| PEI Polymer 1* | 0.32 |
| PEI Polymer 2** | — |
| Brightener | 0.05 |
| Solvent | 3.50 |
| Minors (e.g., builder/chelant, formate, buffers/neutralizers, perfume) | 4.51 |
| Water | balance |
| pH | 8.4 |
| AES/LAS Ratio | 4.0 |
| AES Average Chain Length (carbons) | 14.5 |
| Total Surfactant | 10 |

Samples containing 100 parts of the base composition are provided. To these samples, certain PEI polymers (by parts per 100 parts of the base composition) are added as provided in Table 5B. The viscosity of the resulting compositions is measured as described in the Test Methods Section.

TABLE 5B

| | Ex 15 | Ex 16 | Ex 17 | Ex 18 | Ex 19 |
|---|---|---|---|---|---|
| PEI Polymer 1* (parts added per 100 parts of base composition) | No add'l added (0.32 total) | No add'l added (0.32 total) | No add'l added (0.32 total) | 0.50 (0.82 total) | 1.00 (1.32 total) |
| PEI Polymer 2** (parts added per 100 parts of base composition) | 0.00 | 0.50 | 1.00 | 0.00 | 0.00 |
| Viscosity in mPa · s (20/s @ 20° C.) | 5514 | 551 | 493 | 4233 | 4427 |

*PEI polymer 1 = ethoxylated polyethyleneimine (PEI600 EO20, ex BASF)
*PEI polymer 2 = ethoxylated/propoxylated polyenthyleneimine (PEI600 EO24 PO16, ex BASF)

As shown in Table 5B, the addition of the PEI polymers can reduce the viscosity of the tested compositions. In particular, PEI Polymer 2 (PEI600 EO24 PO16) provides a marked decrease in viscosity; compare Example 15 with Examples 16 and 17. The results in Table 5B also indicate that the performance benefits associated with PEI Polymer 1 level off as the amount is increased; compare Examples 15, 18, and 19. Notably, in addition to reducing the viscosity of the test compositions, PEI Polymers 1 and 2 also provide performance benefits in laundry applications, such as soil anti-redeposition and/or whitening benefits.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

about 5% to about 20%, by weight of the liquid detergent composition of a surfactant system, the surfactant system comprising from about 6% to about 12% by weight of the composition of an alkyl ethoxylated sulfate surfactant which has an alkyl portion with an average of 13.9 to about 14.6 carbon atoms and an average degree of ethoxylation of about 1.8, and from about 2% to about 7% by weight of the composition of a linear alkyl benzene sulfonate surfactant, and an alkoxylated polyalkyleneimine;

wherein composition has a viscosity of between 500 mPa*s and 2000 mPa*s, measured at 20 $s^{-1}$ and 20° C.

2. The liquid detergent composition according to claim 1, wherein at least 60% of the AES includes an alkyl portion having 14 or more carbon atoms.

3. The liquid detergent composition according to claim 1, wherein the surfactant system comprises from about 0.1% to about 2%, by weight of the composition, of amine oxide.

4. The liquid detergent composition according to claim 1, wherein the composition further comprises a detergent adjunct selected from the group consisting of fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, and mixtures thereof.

5. The liquid detergent composition according to claim 1, wherein the composition further comprises at least about 50%, by weight of the composition, of water.

6. The liquid detergent composition according to claim 1, wherein the alkoxylated polyalkyleneimine is a polyethyleneimine comprising inner polyethylene oxide blocks and outer polypropylene oxide blocks, where the ratio of polyethylene oxide blocks to polypropylene oxide blocks (n/p) is from about 1 to about 5.

7. The liquid detergent composition according to claim 1, wherein the liquid detergent composition comprises alkyl ethoxylated sulfate surfactant at between about 6.5% to about 11.5% by weight of the composition.

8. The liquid detergent composition according to claim 1, wherein the alkoxylated polyalkyleneimine comprises a propoxylated polyethyleneimine having a molecular weight of about 600 g/mol with a molar ratio of ethoxylate groups to propoxylate groups of about 24:16.

9. The liquid detergent composition according to claim 7, wherein the composition comprises less than about 2%, by weight of the composition, of an inorganic salt.

10. The liquid detergent composition according to claim 9, wherein the composition is substantially free of external structurants, wherein the external structurants are selected from the group consisting of polymeric structurants, non-polymeric crystalline hydroxy-functional structurants, and combinations thereof.

11. The liquid detergent composition according to claim 9, wherein the composition includes less than about 1% of anionic mid-chain branched surfactant.

12. A liquid detergent composition comprising:

about 5% to about 20%, by weight of the liquid detergent composition of a surfactant system, the surfactant system comprising from about 6% to about 12% by weight of the composition of an alkyl ethoxylated sulfate surfactant which has an alkyl portion with an average of 13.9 to about 14.6 carbon atoms and an average degree of ethoxylation of about 1.8, and from about 2% to about 7% by weight of the composition of a linear alkyl benzene sulfonate surfactant, and an amine oxide;

wherein composition has a viscosity of between 500 mPa*s and 2000 mPa*s, measured at 20 $s^{-1}$ and 20° C.

13. The composition of claim 12, wherein the composition comprises from about 0.5% to about 1.0% of the amine oxide.

14. The composition of claim 13, wherein the composition further comprises an alkoxylated polyalkyleneimine.

15. The composition of claim 14, wherein the alkoxylated polyalkyleneimine comprises an ethoxylated polyalkyleneimine with an average of about 20 ethoxylate groups, an ethoxylated/propoxylated polyalkyleneimine with an average of about 24 ethoxylate groups and about 16 propoxylate groups, or a combination thereof.

16. The composition of claim 15, wherein the composition comprises from about 0.3% to about 3% by weight of the composition of the alkoxylated polyalkyleneimine.

17. The composition of claim 16, wherein the composition further comprises water, brightner, solvent, builder, chelant, buffer, neutralizer, perfume, or a combination thereof.

* * * * *